US008567222B2

(12) United States Patent
Ichikawa et al.

(10) Patent No.: US 8,567,222 B2
(45) Date of Patent: Oct. 29, 2013

(54) MANUFACTURING METHOD FOR INSULATED ELECTRIC WIRE AND ITS MANUFACTURING APPARATUS

(75) Inventors: Shinji Ichikawa, Tokyo (JP); Satoshi Saito, Tokyo (JP)

(73) Assignee: Furukawa Electric Co., Ltd., Tokyo (JP)

( * ) Notice: Subject to any disclaimer, the term of this patent is extended or adjusted under 35 U.S.C. 154(b) by 863 days.

(21) Appl. No.: 12/531,382

(22) PCT Filed: Mar. 31, 2008

(86) PCT No.: PCT/JP2008/000830

§ 371 (c)(1),
(2), (4) Date: Apr. 1, 2010

(87) PCT Pub. No.: WO2008/126387

PCT Pub. Date: Oct. 23, 2008

(65) Prior Publication Data

US 2010/0180652 A1 Jul. 22, 2010

(30) Foreign Application Priority Data

Mar. 30, 2007 (JP) ..... 2007-091981

(51) Int. Cl.

| | |
|---|---|
| ***B21B 45/00*** | (2006.01) |
| ***B21B 15/00*** | (2006.01) |
| ***B21C 1/04*** | (2006.01) |

(52) U.S. Cl.
USPC ..... 72/46; 72/206; 72/278

(58) Field of Classification Search
USPC ..... 72/46, 342.1, 342.94, 206, 278, 279, 72/289, 8.6, 10.3, 11.4, 12.3, 205; 700/151, 152
See application file for complete search history.

(56) References Cited

U.S. PATENT DOCUMENTS

| | | | | |
|---|---|---|---|---|
| 4,145,902 | A * | 3/1979 | Imai et al. | 72/8.6 |
| 4,204,417 | A * | 5/1980 | McVoy, Jr. | 72/206 |
| 6,925,703 | B2 * | 8/2005 | Harada et al. | 29/605 |

FOREIGN PATENT DOCUMENTS

| | | | |
|---|---|---|---|
| JP | 2002-109974 | A | 4/2002 |
| JP | 2003-317547 | * | 11/2003 |

* cited by examiner

*Primary Examiner* — Dana Ross
*Assistant Examiner* — Mohammad I Yusuf
(74) *Attorney, Agent, or Firm* — Kubotera & Associates, LLC

(57) ABSTRACT

The present invention relates to a method of manufacturing an insulated electric wire and an apparatus for manufacturing an insulated electric wire that can stably manufacture a conductor having a larger sectional width according to desired dimensions as compared to the rolling where the conductor is rolled by a pair of rolling rolls free-rotated, and that can conduct the entire process in a tandem arrangement.

9 Claims, 8 Drawing Sheets

MANUFACTURING METHOD FOR INSULATED ELECTRIC WIRE AND ITS MANUFACTURING APPARATUS

TECHNICAL FIELD

The present invention relates to a method of manufacturing an insulated electric wire and an apparatus for manufacturing the insulated electric wire wherein the insulated electric wire is made by covering an insulating coat on a conductor.

BACKGROUND ART

A conventional method of manufacturing an insulated electric wire is disclosed (see prior art document) wherein the insulated electric wire covered by an insulating coat has a rectangular cross-sectional shape. In the prior art, a conductor having a circular cross-sectional shape is rolled by a pair of rolls constituting a cassette roll die CRD to form the rectangular cross-sectional shape. Then, the conductor having the rectangular cross-sectional shape is annealed in an annealing furnace so as to remove distortion formed therein upon rolling to become flexible. Next, enamel varnish is covered on the conductor after annealing, and the enamel varnish covered on the conductor is baked in a baking furnace. The prior art document is Japanese Patent Publication No. 3604337.

In the conventional method of manufacturing the insulated electric wire, free rolls rotating freely without a drive mechanism are adopted as the pair of rolls. A distance between the rolls is adjusted small such that the conductor can be rolled in a width direction thereof, while passing through the distance between the rolls (see the prior art document).

For example, a reduction rate by one pair of free rolls is desirably in a range between 5% and 30%. When the reduction rate by the free rolls exceeds a predetermined value, the conductor is not rolled in the width direction even upon the rolling through the free rolls, and rolled in the lengthwise direction thereof.

That is, when the reduction rate by the free rolls is over the predetermined value, an angle of the conductor rolled with the rolls becomes large, thereby increasing a back tension applied to the conductor.

Therefore, when the reduction rate by the free rolls is large, a force exceeding a breaking load is applied to the conductor so that the conductor may be broken out upon the rolling operation.

As a result, according to the conventional method, only the conductor having a rectangular cross-sectional shape and a ratio of a thickness to a width of about 1:2 is manufactured.

In the conventional method, a driving roll is employed and the rolling rolls rotate at a predetermined speed, it is difficult to stably manufacture the conductor having a desired width due to facility-associated factors.

Further, in order to improve product quality and extend a length of the insulated electric wire, it is necessary to perform an entire process from the rolling where the conductor having the circular cross-sectional shape is rolled to have the rectangular cross-sectional shape to the enamel varnish-coating and baking process in a tandem arrangement. However, it is difficult to conduct the manufacturing process in the tandem arrangement because of width instability of the conductor.

DISCLOSURE OF THE INVENTION

Technical Problem

Accordingly, the present invention has been made in an effort to solve the above problems occurring in the prior art, and it is an object of the present invention to provide a method of manufacturing an insulated electric wire and an apparatus for manufacturing the insulated electric wire, that can stably manufacture a conductor having a wider cross-section width with desired dimensions as compared to the rolling manner where the conductor is rolled by a pair of rolling rolls free-rotated, and that can conduct the entire process in a tandem arrangement.

Technical Solution

To achieve the above object, according to claim 1, there is provided a method of manufacturing an insulated electric wire including the steps of: conducting a conductor rolling process where a conductor is rolled to a predetermined shape; and conducting a conductor coat baking process where an insulating coat is applied on the conductor rolled to the predetermined shape in the conductor rolling process, thereby manufacturing the insulated electric wire, wherein in the conductor rolling process the conductor is rolled to the predetermined shape by means of a pair of rolling rolls rotated by a drive mechanism, and the distance between the rolling rolls is variably controlled, depending upon the variation of the width of the conductor after the rolling.

According to the present invention, the conductor is rolled to the predetermined shape by means of the pair of rolling rolls rotated by the drive mechanism, and therefore, even when the conductor is rolled with a high reduction rate, the conductor is forcedly sent by means of the drive mechanism, such that the rolling process is conducted with small back tension applied to the conductor.

Therefore, even when the reduction rate is high, the force exceeding the breaking load is not applied to the conductor, thereby preventing the conductor from being broken during the rolling. Therefore, according to the present invention, the conductor having a rectangular cross-sectional shape and a ratio of thickness to width of 1:2 or more can be manufactured.

The conductor after the rolling process may be varied in the width dimension thereof, and also, the rolling rolls may be varied in the diameters thereof by the thermal expansion thereof. The variations may be remarkably made when the conductor is rolled at a state of having the reduction rate raised.

According to the present invention, since the distance between the rolling rolls is variably controlled, depending upon the variation of the width of the conductor after the rolling process, the width of the conductor after the rolling can be controlled to a desired value, and further, the conductor, which has a larger sectional width as compared to the rolling manner where the conductor is rolled by a pair of rolling rolls free-rotated, can be stably manufactured according to desired dimensions.

According to claim 2, in the method described in claim 1, the rotating speed of the rolling rolls through the drive mechanism is variably controlled, depending upon the extension of the conductor to the lengthwise direction after the rolling process.

According to the present invention, the rotating speed of the rolling rolls can be variably controlled so as to suppress the variation of the extension of the conductor.

Further, the conductor fed to the rolling rolls has the sectional dimension varied after the rolling, but the variation of the sectional dimension of the conductor includes the variation of the extension of the conductor to the lengthwise direction (which is simply referred to as 'extension') as well as the width variation of the conductor after the rolling.

That is, since the rotating speed of the rolling rolls is variably controlled, the variation in the extension of the conductor is suppressed, which gives an effect to the width of the conductor, and contrarily, if the distance between the rolling rolls is controlled, the variation of the width of the conductor is suppressed, which gives an effect to the extension of the conductor.

Since the rotating speed of the rolling rolls and the distance between the rolling rolls are all controlled, the width of the conductor becomes repeatedly large or small, thereby preventing the disconnection of the conductor and stabilizing the variation of the width of the conductor.

According to claim 3, in the method described in claim 1, the feeding speed of the conductor is variably controlled to suppress the variation of the tension of the conductor fed to the pair of rolling rolls.

According to the present invention, since the tension of the conductor is stabilized before the conductor is fed to the rolling rolls, the rolling process by the rolling rolls can be stably carried out.

According to claim 4, in the method described in claim 2, the method of manufacturing the insulated electric wire includes the steps of: conducting a conductor feeding process where the conductor is fed for the conductor rolling process; conducting a conductor wire drawing process where the conductor is rolled by means of a pair of rolling rolls free-rotated, not by means of a drive mechanism and where the conductor is passed through a die so as to wire-draw the conductor to the predetermined shape; conducting a conductor annealing process where the conductor wire-drawn in the conductor wire drawing process in the conductor annealing means is annealed and fed for the coat baking process; and conducting an electric wire winding process where the electric wire covered with an insulating coat through the coat baking process is taken up by means of electric wire winding means, wherein the entire process from the conductor feeding process to the electric wire winding process is conducted in a tandem arrangement.

The feeding speed of the conductor in the coat baking process is desirably maintained constantly. When the entire process is conducted in a tandem arrangement, if it is desired that the feeding speed of the conductor in the coat baking process is maintained constantly, it is appreciated that the variation of the tension of the conductor occurs. Thus, the tension of the conductor after the rolling is varied, which gives an effect to the width of the conductor. According to the present invention, however, the rotating speed of the rolling rolls and the distance between the rolling rolls are all controlled before the coat baking process, such that when the entire process is conducted in a tandem arrangement, no disconnection on the conductor occurs and the variation of the width of the conductor is effectively suppressed.

As the entire process of the manufacturing method according to the present invention is conducted in a tandem arrangement, there is no need to wind up an intermediate product (conductor) between the processes, thereby overcoming the problem that the product is damaged by the winding process and making the insulated electric wire to a substantially extended length.

To achieve the above object, according to claim 5, there is provided an apparatus for manufacturing an insulated electric wire including: conductor rolling means adapted to roll a conductor to a predetermined shape and coat baking means adapted to bake an insulating coat on the conductor rolled to the predetermined shape by the conductor rolling means, thereby manufacturing the insulated electric wire, wherein the conductor rolling means includes a pair of rolling rolls adapted to be rotated by means of a drive mechanism so as to roll the conductor to the predetermined shape, the pair of rolling rolls having a distance therebetween variably controlled, depending upon the variation of the width of the conductor after the rolling.

According to the present invention, since the conductor is rolled to the predetermined shape by means of the pair of rolling rolls rotated by the drive mechanism, a reduction rate is raised such that the conductor is forcedly sent by means of the drive mechanism while being rolled, which enables the rolling process to be conducted with small back tension applied to the conductor.

Therefore, even when the reduction rate is high, the force exceeding the breaking load is not applied to the conductor, thereby preventing the conductor from being broken during the rolling. Therefore, according to the present invention, the conductor having a rectangular cross-sectional shape and a high ratio of thickness to width thereof, for example, a ratio of thickness to width of 1:2 or more can be manufactured.

The conductor after the rolling process may be varied in the width dimension thereof, and also, the rolling rolls may be varied in the diameters thereof by the thermal expansion thereof. The variations may be remarkably made when the conductor is rolled at a state of having the reduction rate raised.

According to the present invention, since the distance between the rolling rolls is variably controlled, depending upon the variation of the width of the conductor after the rolling process, the width of the conductor after rolled can be controlled to a desired value, and further, the conductor, which has a larger sectional width as compared to the rolling manner where the conductor is rolled by a pair of rolling rolls freely rotating, can be stably manufactured according to desired dimensions.

According to claim 6, in the apparatus described in claim 5, the rotating speed of the rolling rolls through the drive mechanism is variably controlled, depending upon the position of a dancer roll around which the conductor after the rolling process is wound.

According to the present invention, the rotating speed of the rolling rolls can be variably controlled so as to suppress the variation of the extension of the conductor.

That is, since the extension of the conductor is varied when the width of the conductor is varied after the rolling process, the position of the dancer roll is varied to cause the rotating speed of the rolling rolls to be varied, thereby suppressing the variation of the extension of the conductor.

Since the rotating speed of the rolling rolls is variably controlled, the variation in the extension of the conductor is suppressed, which gives an effect to the width of the conductor, and contrarily, if the distance between the rolling rolls is controlled, the variation of the width of the conductor is suppressed, which gives an effect to the extension of the conductor.

Accordingly, since the rotating speed of the rolling rolls and the distance between the rolling rolls are all controlled, the width of the conductor becomes repeatedly large or small, thereby preventing the disconnection of the conductor and stabilizing the variation of the width of the conductor.

According to claim 7, in the apparatus described in claim 5 or 6, the rotating speed of the rolling rolls is compared with the feeding speed of the conductor to the pair of rolling rolls, and depending upon the compared result, the feeding speed of the conductor is variably controlled.

According to the present invention, since the variation of the tension of the conductor is suppressed and the tension of the conductor is stabilized before the conductor is fed to the rolling rolls, the rolling process by the rolling rolls can be stably carried out.

According to claim 8, in the apparatus described in claim 6, the apparatus for manufacturing the insulated electric wire includes: conductor feeding means adapted to feed the conductor to the conductor rolling means; conductor wire drawing means adapted to roll the conductor rolled through the conductor rolling means by means of a pair of rolling rolls free-rotated, not by means of a drive mechanism and to pass the conductor through a die so as to wire-draw the conductor to the predetermined shape; conductor annealing means adapted to anneal the conductor wire-drawn through the conductor wire drawing means and to feed the annealed conductor to the coat baking means; and electric wire winding means adapted to wind an insulated electric wire covered with the insulated coat through the coat baking means, wherein the entire means including the conductor feeding means, the conductor wire drawing means, the conductor annealing means, and the electric wire winding means is disposed in a tandem arrangement.

The coat baking speed on the conductor through the coat baking means is desirably maintained constantly. When the entire process is conducted in a tandem arrangement, if it is desired that the coat baking speed on the conductor through the coat baking means is maintained constantly, it is appreciated that the variation of the tension of the conductor occurs. Thus, the tension of the conductor after the rolling is varied, which gives an effect to the width of the conductor. According to the present invention, however, the rotating speed of the rolling rolls and the distance between the rolling rolls are all controlled, such that when the entire process is conducted in a tandem arrangement, no disconnection on the conductor occurs, and the variation of the width of the conductor is effectively suppressed.

As mentioned above, the entire process of the manufacturing method according to the present invention is conducted in a tandem arrangement, there is no need to wind an intermediate product (conductor) between the processes, thereby overcoming the problem that the product is damaged by the winding process and making the insulated electric wire to a substantially extended length.

Advantageous Effect of the Invention

According to the present invention, there are provided the method of manufacturing the insulated electric wire and the apparatus for manufacturing the insulated electric wire wherein the conductor is rolled by means of the pair of rolling rolls rotated by the drive mechanism and also the distance between the rolling rolls is variably controlled depending upon the variation of the width of the conductor after the rolling, such that the conductor having a larger sectional width as compared to the rolling manner where the conductor is rolled by a pair of rolling rolls free-rotated can be stably manufactured according to desired dimensions, and the entire process can be conducted in a tandem arrangement.

Figure 1:
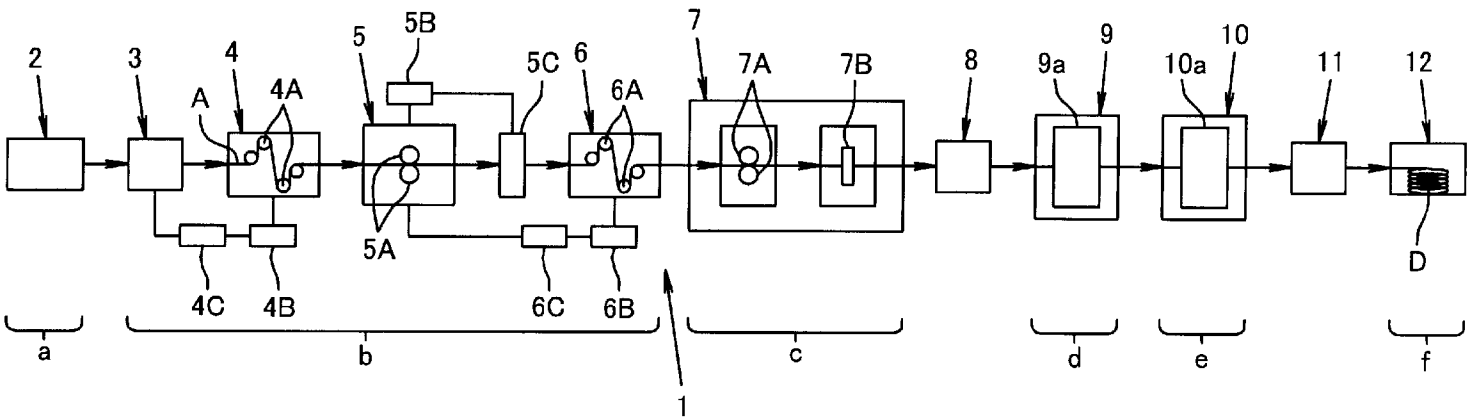
FIG. 1 is a flow chart showing method and apparatus for manufacturing an insulated electric wire according to a preferred embodiment of the present invention.

EXPLANATIONS ON THE REFERENCE NUMERALS OF THE MAIN UNITS IN THE DRAWINGS a - - - conductor feeding process
b - - - conductor rolling process
c - - - conductor wire drawing process
d - - - conductor annealing process
e - - - coat baking process
f - - - electric wire winding process
A - - - conductor
B - - - insulating coat
D - - - insulated electric wire
1 - - - manufacturing apparatus
2 - - - conductor feeding unit
3 - - - feed capstan
4 - - - feed dancer roll
4A - - - roll
4B - - - potential meter
4C - - - feeding speed controller
5 - - - conductor rolling unit
5A - - - rolling roll
5B - - - distance adjuster
5C - - - conductor dimension monitor
6 - - - feed-out dancer roll
6A - - - roll
6B - - - potential meter
6C - - - rolling speed controller
7 - - - conductor wire drawing unit
7A - - - rolling roll
7B - - - die
8 - - - tension capstan
9 - - - conductor annealing unit
10 - - - coat baking unit
11 - - - pull-up capstan
12 - - - electric wire winding unit

PREFERRED EMBODIMENTS OF THE INVENTION

The object of the present invention is accomplished by rolling a conductor by means of a pair of rolling rolls rotated by a drive mechanism such that the conductor, which has a larger sectional width as compared to the rolling manner where the conductor is rolled by a pair of rolling rolls free-rotated, can be stably manufactured according to desired dimensions.

Hereinafter, an explanation on the method and apparatus for manufacturing an insulated electric wire according to the present invention will be given with reference to the attached drawings.

Figure 4:
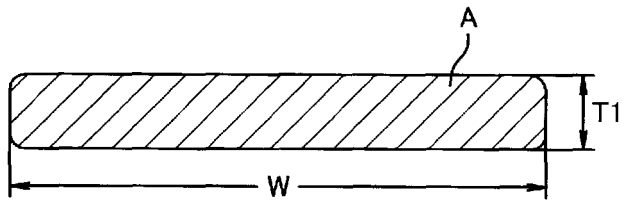
FIG. 4 is a sectional view showing the conductor rolled to a rectangular cross-sectional shape.
Figure 5:
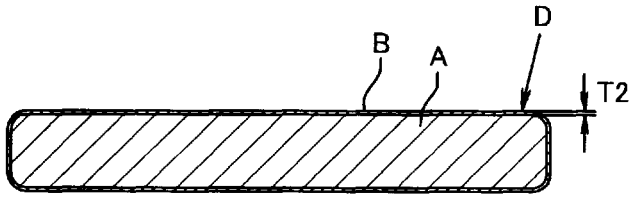
FIG. 5 is a sectional view showing the insulated electric wire covered by an insulating coat.

As shown in FIG. 5, there are provided the method and apparatus for manufacturing an insulated electric wire according to the present invention wherein the insulated electric wire D is made by coating a conductor A (see FIG. 4) which is formed of a conductive metal material and wire-drawn to have a rectangular sectional shape having a thickness T1 of 1 mm and a width W of 3.5 mm with an insulating coat B formed of an enamel varnish and having a thickness T2 of 40 μm.

In the method of manufacturing the insulated electric wire according to the present invention, as shown in FIG. 1, a conductor feeding process a, a conductor rolling process b, a conductor wire drawing process c, a conductor annealing process d, a coat baking process e, and an electric wire winding process f are conducted in a tandem arrangement. That is, in the conductor feeding process a, the conductor A fed to a conductor feeding unit 2 is supplied for the conductor rolling process b through a feed capstan 3 and a feed dancer roll 4.

In the conductor rolling process b, the conductor A is rolled by a pair of upper and lower rolling rolls 5A and 5A rotated by a drive mechanism of a conductor rolling unit 5 in a width direction thereof (see FIG. 2) and is fed for the conductor wire drawing process c through a send-out dancer roll 6.

Figure 3:
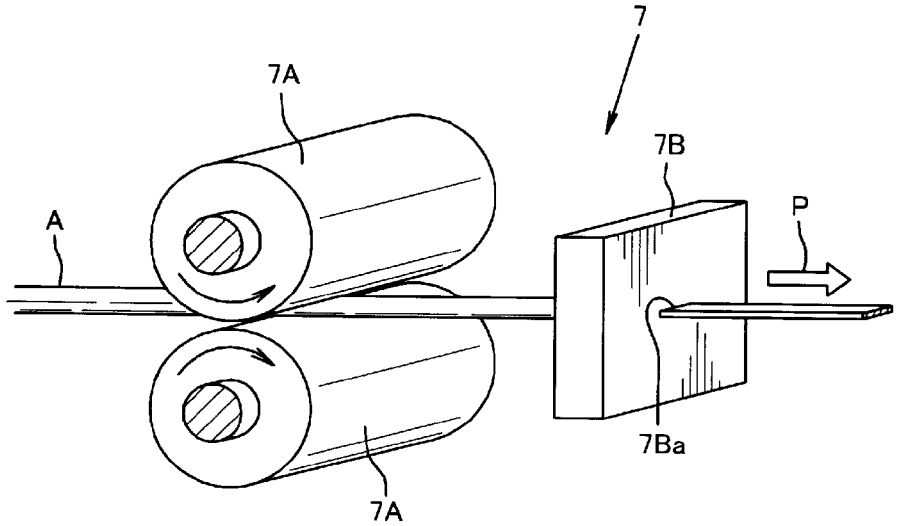
FIG. 3 is a perspective view showing the wire-drawing operation for the conductor by means of a conductor wire drawing unit.

In the conductor wire drawing process c, the conductor A rolled by the conductor rolling unit 5 is rolled by a pair of rolling rolls 7A and 7A free-rotated in a conductor wire drawing unit 7, not by means of a drive mechanism, and is wire-drawn to predetermined shape and dimension by means of a die 7B (see FIG. 3). Next, the conductor A (see FIG. 4) rolled and wire-drawn to have the rectangular cross-sectional shape is fed for the conductor annealing process d through a tension capstan 8.

In the conductor annealing process d, the conductor A wire-drawn by the conductor wire drawing unit 7 is annealed by an annealing furnace 9*a* of a conductor annealing unit 9 and is fed for the coat baking process e.

In the coat baking process e, the conductor A annealed by the conductor annealing unit 9 is covered with enamel varnish and baked by a baking furnace 10*a* of a coat baking unit 10. After that, the insulated electric wire D (see FIG. 5) covered with an insulating coat B formed of the enamel varnish is fed for the electric wire winding process f.

In the electric wire winding process f, the insulated electric wire D covered with the insulating coat B is wound around an electric wire winding unit 12 through a pull-up capstan 11.

Like this, according to the method of manufacturing the insulated electric wire, the entire process from the conductor feeding process a to the electric wire winding process f is conducted in a tandem arrangement.

An apparatus for manufacturing the insulated electric wire D by using the manufacturing method includes the conductor feeding unit 2, the feed capstan 3, the feed dancer roll 4, the conductor rolling unit 5, the send-out dancer roll 6, the conductor wire drawing unit 7, the tension capstan 8, the conductor annealing unit 9, the coat baking unit 10, the pull-up capstan 11, and the electric wire winding unit 12, which are disposed in a tandem arrangement in the above-mentioned order (see FIG. 1).

Besides, the conductor feeding process a is conducted by means of the conductor feeding unit 2, and the conductor rolling process b (is conducted) by means of the feed capstan 3, the feed dancer roll 4, the conductor rolling unit 5, and the send-out dancer rolls 6. Further, the conductor wire drawing process c is conducted by means of the conductor wire drawing unit 7, and the conductor annealing process d by means of the conductor annealing unit 9. Next, the coat baking process e is conducted by means of the coat baking unit 10, and the electric wire winding process f by means of the electric wire winding unit 12.

The conductor feeding unit 2 in the conductor feeding process a serves to continuously feed the conductor A provided, for example, from a conductor manufacturing factory to the feed capstan 3, the feed dancer roll 4, and the conductor rolling unit 5 (see FIG. 1).

The feed capstan 3 in the conductor rolling process b is rotated by a drive mechanism which is not shown in the drawing, so as to feed the conductor A fed from the conductor feeding unit 2 to the feed dancer roll 4 (see FIG. 1).

The feed dancer roll 4 in the conductor rolling process b includes a pair of upper rolls 4A and a pair of lower rolls 4A around which the conductor A is wound, a potential meter 4B detecting the variation of the positions of the rolls 4A and 4A, and a feeding speed controller 4C controlling the feeding speed of the feed capstan 3. The feed dancer roll 4 having the above configuration serves to maintain the conductor A fed from the feed capstan 3 with (appropriate) tension by means of the upward and downward movements of the lower rolls 4A and to feed the conductor A to the conductor rolling unit 4 in the conductor rolling process b (see FIG. 1).

In other words, in the apparatus for manufacturing the insulated electric wire according to the present invention, in the conductor rolling process b the rotating speed of the rolling rolls 5A is compared with the feeding speed of the conductor A fed between the rolling rolls 5A and 5A, and depending upon the compared result, the feeding speed of the conductor A is variably controlled.

In more detail, if the conductor A wound around the upper and lower rolls 4A and 4A becomes loose, the lower rolls 4A are descended to permit the distance between the upper and lower rolls 4A and 4A to be large, and contrarily, if the conductor A is tense, the lower rolls 4A are ascended to permit the distance between the upper and lower rolls 4A and 4A to be narrow.

Like this, according to the tension of the conductor A wound around the upper and lower rolls 4A, the relative positions of the rolls 4A are varied, and the variation of the positions of the upper and lower rolls 4A and 4A is detected by means of the potential meter 4B. The detected signal is outputted to the feeding speed controller 4C.

The feeding speed controller 4C serves to variably control the feeding speed of the conductor A through the feed capstan 3, depending upon the detected signal outputted from the potential meter 4B, thereby controlling the feeding speed of the conductor A supplied to the conductor rolling unit 5.

Besides, in order to suppress the variation of the tension of the conductor A to be fed to the rolling rolls 5A and 5A, the feeding speed of the conductor A is variably controlled by means of the potential meter 4B or the feed dancer roll 4, but it is not limited thereto.

For example, the rotating speed of the rolling rolls 5A and 5A and the feeding speed of the conductor A are directly detected by means of an encoder or a tacho-generator as speed detecting means, and after the detected values are compared with each other, the feeding speed of the conductor A is variably controlled.

Figure 2:
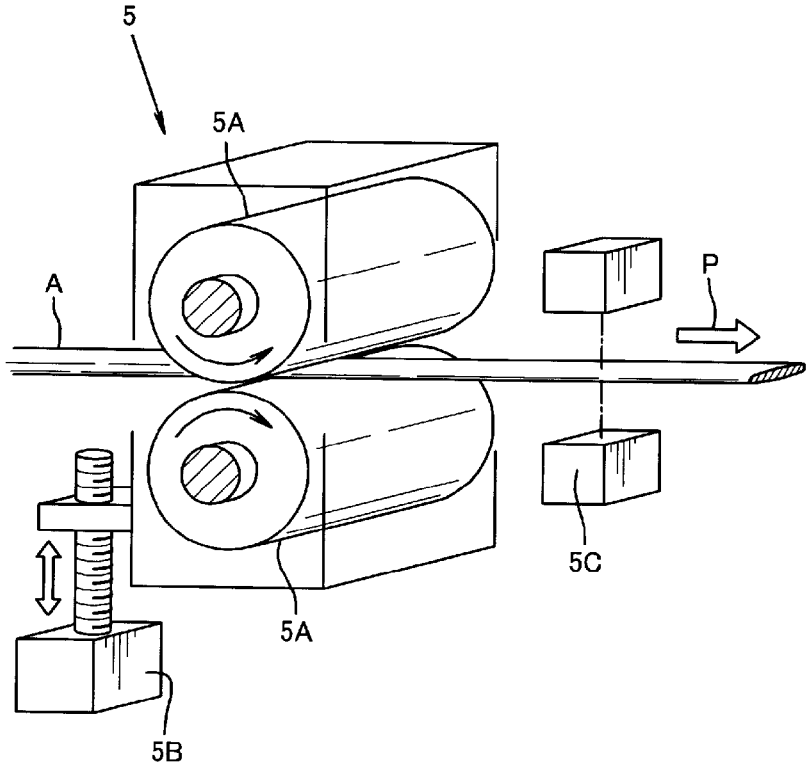
FIG. 2 is a perspective view showing the rolling operation for the conductor by means of a conductor rolling unit.

The conductor rolling unit 5 in the conductor rolling process b serves to roll the conductor A by means of the pair of upper and lower rolling rolls 5A and 5A, as shown in FIG. 2, rotated by the drive mechanism (not shown) to have a rectangular cross-sectional shape and to variably control the distance between the rolling rolls 5A and 5A, depending upon the variation of the width of the conductor A after the rolling.

In more detail, the conductor rolling unit 5 in the conductor rolling process b includes a distance adjuster 5B adapted to variably adjust the distance between the rolling rolls 5A and 5A as shown in FIG. 2 rotated by the drive mechanism by means of a drive mechanism (not shown) and a conductor dimension monitor 5C adapted to optically detect the dimension (the width W in FIG. 4) of the conductor A rolled by the rolling rolls 5A and 5A.

The conductor rolling unit 5 having the above configuration extends the conductor A fed thereto in the width direction thereof by the rolling rolls 5A and 5A to have desired thickness and width and feeds the extended conductor A to the conductor wire drawing unit 7 in the conductor wire drawing process c through the send-out dancer roll 6. For example, a mechanical conductor dimension monitor may be adopted instead of the optical conductor dimension monitor 5C.

The conductor dimension monitor 5C optically measures the dimension (the width W in FIG. 4) of the conductor A rolled by the rolling rolls 5A and 5A and determines whether the conductor A is rolled to have the desired dimension, depending upon the measured result. The determination result is outputted to the distance adjuster 5B as will be discussed below.

The pair of rolling rolls 5A and 5A are the rolls that have the outer peripheral surfaces in an axial direction having the same diameter as each other, and so as to extend the conductor A having the circular cross-sectional shape to the width direction in such a manner as to have a rectangular cross-sectional shape, they are disposed in a parallel relation to each other.

Besides, if it is desired that the conductor A has other cross-sectional shapes instead of rectangular cross-sectional shape, the rolling rolls 5A and 5A are adopted in accordance with desired shapes.

Also, the pair of rolling rolls 5A and 5A are disposed movably with respect to each other in a direction where the distance between them becomes narrow and in a direction where the distance between them becomes large by means of the distance adjuster 5B as will be discussed below.

That is, the conductor A having the circular cross-sectional shape fed between the pair of rolling rolls 5A and 5A is induced to a drawing direction P by means of a conductor pull-out unit which is not shown, and at the same time, the rolling rolls 5A and 5A are rotated by means of the drive mechanism which is not shown and roll the conductor A fitted between them to the rectangular cross-sectional shape (see FIG. 2).

The distance adjuster 5B serves to move the pair of rolling rolls 5A and 5A with respect to each other in the direction where the distance between the rolls becomes narrow and in the direction where the distance between the rolls becomes large, depending upon the measured result for the conductor A by the conductor dimension monitor 5C, such that the distance between the pair of rolling rolls 5A and 5A is variably adjusted to a distance where the conductor A is rolled to have the desired thickness and width.

That is, the extension rate to the width direction of the conductor A is varied by the wire diameter or the tension force applied to the length direction of the conductor A. Also, even though the conductor A having an equal thickness is rolled, the width of the conductor A is varied.

Therefore, if it is determined that the width of the conductor A is smaller than a predetermined with by the detection of the conductor dimension monitor 5C, the pair of rolling rolls 5A and 5A move to each other in the direction where the distance between them becomes narrow, thereby permitting the distance between them to be narrow. As a result, the extension rate to the width direction of the conductor A is increased, which allows the width of the conductor A being rolled to be large.

Contrarily, if it is determined that the width of the conductor A is larger than the predetermined with by the detection of the conductor dimension monitor 5C, the pair of rolling rolls 5A and 5A move to each other in the direction where the distance between them becomes large, thereby permitting the distance between them to be large. As a result, the extension rate to the width direction of the conductor A is decreased, which allows the width of the conductor A being rolled to be reduced.

The send-out dancer roll 6 right after the conductor dimension monitor 5C includes a pair of upper rolls 6A and a pair of lower rolls 6A around which the conductor A is wound, a potential meter 6B detecting the variation of the positions of the upper and lower rolls 6A and 6A, and a rolling speed controller 6C controlling the rotating speed of the rolling rolls 5A and 5A of the conductor rolling unit 5. The send-out dancer roll 6 having the above configuration serves to maintain the conductor A fed from the conductor rolling unit 5 with predetermined tension by means of the upward and downward movements of the lower rolls 6A and to feed the conductor A to the conductor wire drawing unit 7 in the conductor wire drawing process c (see FIG. 1).

The manufacturing apparatus 1 of this invention is configured to variably control the rotating speed of the rolling rolls 5A and 5A rotated by the drive mechanism, depending upon the position of the send-out dancer roll 6 around which the conductor A after rolling is wound.

In more detail, in the same manner as the feed dancer roll 4, the relative positions of the rolls 6A and 6A are varied, depending upon the tension degree of the conductor A wound along the upper and lower rolls 6A and 6A. At this time, the variation of the positions of the upper and lower rolls 6A and 6A is detected by means of the potential meter 6B. The detected signal is outputted to the rolling speed controller 6C. The rolling speed controller 6C serves to variably control the rotating speed of the rolling rolls 5A and 5A of the conductor rolling unit 5, depending upon the detected signal outputted from the potential meter 6B, thereby controlling the rotating speed of the rolling rolls 5A and 5A where the conductor A is rolled to have the rectangular cross-sectional shape.

As shown in FIG. 3, the conductor wire drawing unit 7 in the conductor wire drawing process c includes the pair of rolling rolls 7A and 7A free-rotated by the contact resistance with the conductor A, not by means of a drive mechanism which is not shown, and the die 7B adapted to wire-draw the conductor A rolled in the rectangular cross-sectional shape by the rolling rolls 7A and 7A to predetermined shape and dimension. The conductor wire drawing unit 7 having the above configuration serves to roll the conductor A extended to the width direction fed from the conductor rolling unit 5 by means of the rolling rolls 7A and 7A and to wire-draw the conductor A to have the predetermined shape and dimension by means of the die 7B. On the other hand, the upper and lower rolling rolls 7A and 7A are disposed on the cassette roll die CRD.

Since the pair of rolling rolls 7A and 7A roll the conductor A to have the rectangular cross-sectional shape, the opposing rolls are disposed in a parallel relation to each other. That is, the conductor A fed between the pair of rolling rolls 7A and 7A is induced to a drawing direction P by means of a conductor pull-out unit which is not shown, and at the same time, the rolling rolls 7A and 7A are free-rotated by means of the contact resistance with the conductor A. Since the wire diameter of the conductor A is larger than the distance between the rolling rolls 7A and 7A, the conductor A is rolled to the rectangular cross-sectional shape when it is passed through the distance between the rolling rolls 7A and 7A. Also, the conductor A may be rolled by means of the pairs of upper and lower disposed rolling roll as well as right and left sides disposed rolling rolls 7A and 7A.

The die 7B serves to insertedly pass the conductor A rolled by the pair of rolling rolls 7A and 7A through a rectangular cross-sectional hole 7Ba formed thereon, the rectangular cross-sectional hole 7Ba having predetermined set dimensions like thickness, width, chamfered radius and so on, and at the same time, to draw the conductor A passed through the rectangular cross-sectional hole 7Ba in the drawing direction by means of the conductor pull-out unit, with the application of the tension force thereto, such that the conductor A is wire-drawn to the rectangular cross-sectional shape having the desired dimension having a thickness of 1 mm and a width of 3.5 mm (see FIG. 4).

The tension capstan 8 right after the conductor wire drawing unit 7 is rotated by means of a drive mechanism which is not shown and sends the conductor A fed from the conductor wire drawing unit 7 to the conductor annealing unit 9 in the conductor annealing process d (see FIG. 1).

The conductor annealing unit 9 in the conductor annealing process d includes the annealing furnace 9*a* adapted to anneal the conductor A wire-drawn. The conductor annealing unit 9 having the above configuration serves to anneal the conductor A wire-drawn to the rectangular cross-sectional shape by the conductor wire drawing unit 7 in the annealing furnace 9*a* (see FIG. 1). The annealing furnace 9*a* serves to anneal the conductor A being passed therethrough and to remove the distortion formed on the conductor A upon the rolling and the wire-drawing, thereby making the conductor A (flexible).

The coat baking unit 10 in the coat baking process e includes the baking furnace 10*a* adapted to bake the insulating coat B formed on the annealed conductor A therein (see FIG. 1). The coat baking unit 10 having the above configuration serves to bake the insulating coat B formed on the conductor A annealed by the conductor annealing unit 9 in the baking furnace 10*a*. The baking furnace 10*a* serves to coat the enamel varnish formed of polyamideimide resin on the conductor A fed from the annealing furnace 9*a* by means of an applicator which is not shown and successively to bake the conductor A at a furnace temperature in a range between 500° C. and 600° C. In this case, the insulating coat B formed of the enamel varnish is uniformly applied on the conductor A. Besides, the surface temperature of the conductor A is, for example, in a range between 200° C. and 250° C. Also, the furnace temperature, furnace length, and baking speed during the baking are not limited to the values proposed in the present invention, and they may be varied in accordance with the thickness and material of the conductor A. Also, the baking may be repeatedly conducted.

The pull-up capstan 11 right after the coat baking unit 10 is rotated by means of a drive mechanism which is not shown and draws the insulated electric wire D fed from the coat baking unit 10 toward the electric wire winding unit 12 in the electric wire winding process f at a predetermined speed (see FIG. 1).

The electric wire winding unit 12 in the electric wire winding process f is rotated by means of a drive mechanism which is not shown and continuously takes up the insulated electric wire D covered with the insulating coat B fed from the baking furnace 10*a* of the coat baking unit 10 (see FIG. 1).

Besides, the thickness or width of the insulated electric wire D and the thickness of the insulating coat B manufactured by the apparatus of this invention is not limited to the values defined in the present invention, and they may be varied in accordance with the purposes thereof.

Hereinafter, the method of manufacturing the insulated electric wire D by the manufacturing apparatus of this invention will be explained.

As shown in FIG. 1, first, in the conductor feeding process a, the conductor A fed to in the conductor feeding unit 2 is supplied for the conductor rolling process b through the feed capstan 3 and the feed dancer roll 4.

In the conductor rolling process b, the feeding speed of the conductor A is variably controlled so as to suppress the variation of the tension of the conductor A being fed to the pair of rolling rolls 5A and 5A.

In more detail, if the feeding speed of the conductor through the feed dancer roll 4 is faster than the rotating speed of the rolling rolls 5A and 5A of the conductor rolling unit 5, the conductor A wound around the upper and lower rolls 4A and 4A becomes loose, the lower rolls 4A are descended. On the other hand, if the feeding speed of the conductor through the feed dancer roll 4 is slower than the rotating speed of the rolling rolls 5A and 5A of the conductor rolling unit 5, the conductor A becomes tense, the lower rolls 4A are ascended.

In other words, since the positions of the rolls 4A and 4A are varied by the tense degree of the conductor A, the variation of the positions of the rolls 4A and 4B are detected by the potential meter 4B, and the detected signal is sent to the feeding speed controller 4C. The feeding speed controller 4C variably controls the feeding speed of the conductor A fed through the feed capstan 3, depending upon the detected signal outputted from the potential meter 4B, thereby controlling the feeding speed of the conductor A fed to the conductor rolling unit 5.

Like this, as the feeding speed of the conductor A is variably controlled, the tension of the conductor A is stabilized before the feed to the rolling rolls 5A and 5A, such that the rolling process by the rolling rolls 5A and 5A can be stably conducted.

In the conductor rolling process b, as shown in FIG. 2, the conductor A having the circular cross-sectional shape fed between the pair of rolling rolls 5A and 5A of the conductor rolling unit 5 is rolled to have the rectangular cross-sectional shape by means of the rolling rolls 5A and 5A rotated by means of the drive mechanism which is not shown (see FIG. 2). That is, since the wire diameter of the conductor A fed from the conductor feeding unit 2 is larger than the distance between the pair of rolling rolls 5A and 5A, the conductor A is rolled to have the rectangular cross-sectional shape when it is passed through the distance between the rolling rolls 5A and 5A.

The dimension (the thickness T1 and the width W in FIG. 4) of the conductor A rolled by the rolling rolls 5A and 5A is measured by the conductor dimension monitor 5C, and the measured result is outputted to the distance adjuster 5B.

The distance adjuster 5B variably controls the distance between the pair of rolling rolls 5A and 5A, depending upon the measured result by the conductor dimension monitor 5C. That is, if it is determined that the width of the conductor A is more narrow than a predetermined with thereof, the distance between the rolling rolls 5A and 5A becomes reduced to permit the extension rate to the width direction of the conductor A to be increased, thereby making the width of the conductor A being rolled large.

Contrarily, if it is determined that the width of the conductor A is larger than the predetermined width thereof, the distance between the rolling rolls 5A and 5A becomes increased to permit the extension rate to the width direction of the conductor A to be decreased, thereby making the width of the conductor A being rolled reduced up to the predetermined width. The conductor A rolled to the desired dimension is fed through the send-out dancer roll 6 to the conductor wire drawing unit 7 in the conductor wire drawing process c.

Moreover, if the feeding speed of the conductor through the send-out dancer roll 6 is slower than the rotating speed of the rolling rolls 5A and 5A of the conductor rolling unit 5, the conductor A wound around the upper and lower rolls 6A and 6A becomes loose, the lower rolls 6A are descended. On the other hand, if the feeding speed of the conductor through the send-out dancer roll 6 is faster than the rotating speed of the rolling rolls 5A and 5A of the conductor rolling unit 5, the conductor A becomes tense, the lower rolls 6A are ascended.

In other words, since the positions of the rolls 6A and 6A are varied by the tense degree of the conductor A, the variation of the positions of the rolls 6A and 6B are detected by the potential meter 6B, and the detected signal is sent to the rolling speed controller 6C. The rolling speed controller 6C variably controls the rotating speed of the rolling rolls 5A and 5A of the conductor rolling unit 5, depending upon the detected signal outputted from the potential meter 6B, thereby controlling the rotating speed of the conductor A rolled to have the rectangular cross-sectional shape.

Therefore, the rotating speed of the rolling rolls 5A and 5A through the drive mechanism is variably controlled, depending upon the extension of the conductor A to the lengthwise direction after the rolling process.

In more detail, the conductor A fed to the rolling rolls 5A and 5*a* has the sectional dimension generally varied after the rolling, but the variation of the sectional dimension of the conductor A includes the variation of the extension of the conductor to the lengthwise direction as well as the variation of the width of the conductor A after the rolling.

Thus, since the rotating speed of the rolling rolls 5A and 5A is variably controlled, the variation in the extension of the conductor A is suppressed, which gives an effect to the width of the conductor A, and contrarily, if the distance between the rolling rolls 5A and 5A is controlled, the variation of the width of the conductor A is suppressed, which gives an effect to the extension of the conductor A.

As a result, since the rotating speed of the rolling rolls 5A and 5A and the distance between the rolling rolls 5A and 5A are all controlled, the width of the conductor A becomes repeatedly large or small, thereby preventing the disconnection of the conductor A and gradually stabilizing the variation of the width of the conductor A.

In the conductor wire drawing process c, as shown in FIG. 3, the conductor A that is supplied between the rolling rolls 7A and 7A of the conductor wire drawing unit 7 is rolled to have the rectangular cross-sectional shape through the rolling rolls 7A and 7A free-rotated by the contact resistance with the conductor A.

The conductor A rolled by the rolling rolls 7A and 7A is insertedly passed through the rectangular cross-sectional hole 7Ba of the die 7B, and simultaneously, the conductor A passed through the rectangular cross-sectional hole 7Ba is drawn with the tension force toward the drawing direction P by means of the conductor pull-out unit which is not shown so as to have the rectangular cross-sectional shape (see FIG. 4) and is fed to the conductor annealing unit 9 in the conductor annealing process d through the tension capstan 8.

In the conductor annealing process d, the conductor A being fed to the annealing furnace 9*a* of the conductor annealing unit 9 is annealed to remove the distortion formed thereon upon the rolling and the wire-drawing. Next, the conductor A (made flexible) is fed to the coat baking unit 10 in the coat baking process e.

In the coat baking process e, the enamel varnish formed of polyamideimide resin is covered and baked on the conductor A fed to the baking furnace 10*a* of the coat baking unit 10, and the insulated electric wire D (see FIG. 5) covered with the insulating coat B formed of the enamel varnish is fed to the electric wire winding unit 12 in the electric wire winding process f through the pull-out capstan 11.

In the electric wire winding process f, the insulated electric wire D fed from the baking furnace 10*a* of the coat baking unit 10 is taken up by the electric wire winding unit 12, thereby completing the manufacturing of the insulated electric wire D.

As mentioned above, there is provided the method of manufacturing the insulated electric wire according to the present invention including the steps of: conducting the conductor rolling process b where the conductor A is rolled to the rectangular cross-sectional shape and conducting the conductor baking process e where the insulating coat is applied on the rolled conductor A, thereby manufacturing the insulated electric wire D, wherein in the conductor rolling process b the conductor A is rolled to the rectangular cross-sectional shape by means of the pair of rolling rolls 5A and 5A rotated by the drive mechanism, and the distance between the rolling rolls 5A and 5A is variably controlled, depending upon the variation of the width of the conductor A after the rolling.

Further, there is provided the apparatus for manufacturing the insulated electric wire according to the present invention including: the conductor rolling unit 5 adapted to roll the conductor A to the rectangular cross-sectional shape and the coat baking unit 10 adapted to bake the insulating coat on the conductor A rolled to the rectangular cross-sectional shape by the conductor rolling unit 5, thereby manufacturing the insulated electric wire D, wherein the conductor rolling unit 5 includes the pair of rolling rolls 5A and 5A adapted to be rotated by means of the drive mechanism so as to roll the conductor A to the rectangular cross-sectional shape, the pair of rolling rolls 5A and 5A having a distance therebetween variably controlled, depending upon the variation of the width of the conductor A after the rolling.

In the method and apparatus for manufacturing the insulated electric wire according to the present invention, the conductor A is rolled to the rectangular cross-sectional shape by means of the pair of rolling rolls 5A and 5A rotated by the drive mechanism, and therefore, even when the conductor A is rolled with a high reduction rate, the conductor A is forcedly sent by means of the drive mechanism, such that the rolling process is conducted with small back tension applied to the conductor A.

Therefore, even when the reduction rate is high, the force exceeding the breaking load is not applied to the conductor A, thereby preventing the conductor A from being broken during the rolling. Therefore, in the method and apparatus according to the present invention, the conductor A having the rectangular cross-sectional shape and a ratio of thickness to width of 1:10 can be manufactured in simple and easy manners.

Since the rolling rolls 5A and 5A are varied in the diameters thereof by the thermal expansion thereof, it is known the conductor A after the rolling process is varied in the width dimension thereof.

However, in the method and apparatus according to the present invention, since the distance between the rolling rolls 5A and 5A is variably controlled, depending upon the variation of the width of the conductor A after the rolling process, the width of the conductor A after the rolling can be controlled to a desired value, and further, the conductor A, which has a larger sectional width as compared to the rolling manner or configuration where the conductor A is rolled by the pair of rolling rolls 7A and 7A free-rotated, can be stably manufactured according to desired dimensions.

In the manufacturing method according to the present invention, the rotating speed of the rolling rolls 5A and 5A through the drive mechanism is variably controlled, depending upon the extension of the conductor A to the lengthwise direction after the rolling process.

Also, in the manufacturing apparatus according to the present invention, the rotating speed of the rolling rolls 5A and 5A by the drive mechanism is variably controlled, depending upon the position of the send-out dancer roll 6 around which the conductor A after the rolling is wound.

In this case, it can be appreciated that the width of the conductor A after the rolling is varied by the variation of the sectional dimension of the conductor A fed to the rolling rolls 5A and 5A, and also, the extension of the conductor A in the lengthwise direction thereof is varied.

Therefore, in the manufacturing method and apparatus according to the present invention, the rotating speed of the rolling rolls 5A and 5A is variably controlled, depending upon the extension of the conductor A, such that since the extension of the conductor A is varied upon the variation of the width of the conductor A after the rolling, the position of the send-out dancer roll 6 is varied to make the rotating speed of the rolling rolls 5A and 5A varied, thereby suppressing the variation of the extension of the conductor A.

Besides, since the rotating speed of the rolling rolls 5A and 5A is variably controlled, the variation in the extension of the conductor A is suppressed, which gives an effect to the width of the conductor A, and contrarily, if the distance between the rolling rolls 5A and 5A is controlled, the variation of the width of the conductor A is suppressed, which gives an effect to the extension of the conductor A.

In the manufacturing method and apparatus according to the present invention, therefore, since the rotating speed of the rolling rolls 5A and 5A and the distance between the rolling rolls 5A and 5A are all controlled, the width of the conductor A becomes repeatedly large or small, thereby preventing the disconnection of the conductor A and stabilizing the variation of the width of the conductor A.

In the manufacturing method according to the present invention, the feeding speed of the conductor A is variably controlled to suppress the variation of the tension of the conductor A fed to the pair of rolling rolls 5A and 5A.

In the manufacturing apparatus 1 according to the present invention, the rotating speed of the rolling rolls 5A and 5A is compared with the feeding speed of the conductor A to the pair of rolling rolls 5A and 5A, and depending upon the compared result, the feeding speed of the conductor A is variably controlled.

In the manufacturing method and apparatus according to the present invention, since the variation of the tension of the conductor is suppressed and the tension of the conductor A is stabilized before the conductor A is fed to the rolling rolls 5A and 5A, the rolling process by the rolling rolls 5A and 5A can be stably carried out.

According to the present invention, the manufacturing method includes the steps of: conducting the conductor feeding process a where the conductor A is fed for the conductor rolling process b; conducting the conductor wire drawing process c where the conductor A is rolled by means of the pair of rolling rolls 7A and 7A free-rotated, not by means of the drive mechanism and where the conductor A is passed through the die 7B so as to wire-draw the conductor A to the rectangular cross-sectional shape; conducting the conductor annealing process d where the conductor A wire-drawn in the conductor wire drawing process c is annealed in the conductor annealing unit 9 and fed for the coat baking process e; and conducting the electric wire winding process f where the electric wire covered with the insulating coat through the coat baking process is taken up by means of the electric wire winding unit 12, wherein the entire process from the conductor feeding process a to the electric wire winding process f is conducted in a tandem arrangement.

According to the present invention, the manufacturing apparatus 1 includes: the conductor feeding unit 2 adapted to feed the conductor A to the conductor rolling unit 5; the conductor wire drawing unit 7 adapted to roll the conductor A rolled through the conductor rolling unit 5 by means of the pair of rolling rolls 7A and 7A free-rotated, not by means of a drive mechanism and to pass the conductor A through the die 7B so as to wire-draw the conductor A to the rectangular cross-sectional shape; the conductor annealing unit 9 adapted to anneal the conductor A wire-drawn through the conductor wire drawing unit 7 and to feed the annealed conductor A to the coat baking unit 10; and the electric wire winding unit 12 adapted to wind the insulated electric wire D covered with the insulated coat through the coat baking unit 10, wherein the entire unit including the conductor feeding unit 2, the conductor wire drawing unit 7, the conductor annealing unit 9, and the electric wire winding unit 12 is disposed in a tandem arrangement.

The feeding speed of the conductor A in the coat baking process e is desirably maintained constantly. When the entire process is conducted in a tandem arrangement, if it is desired that the feeding speed of the conductor A in the coat baking process e is maintained constantly, it is generally appreciated that the variation of the tension of the conductor A occurs. Thus, the tension of the conductor A after the rolling is varied, which gives an effect to the width of the conductor A. According to the present invention, however, in the conductor rolling process b before the coat baking process e the rotating speed of the rolling rolls 5A and 5A and the distance between the rolling rolls 5A and 5A are all controlled, such that when the entire process is conducted in a tandem arrangement, no disconnection on the conductor A occurs and the variation of the width of the conductor A is effectively suppressed.

As the entire process of the manufacturing method according to the present invention is conducted in a tandem arrangement, there is no need to wind an intermediate product (conductor) between the processes, thereby overcoming the problem that the product is damaged by the winding process and making the insulated electric wire to a substantially extended length.

In addition, while the dimension of the conductor A being rolled by the pair of rolling rolls 5A and 5A is monitored, the distance between the rolling rolls 5A and 5A and the feeding and drawing-out speeds of the conductor A are variably controlled to have appropriate distance and speeds, thereby enhancing the precision of the dimension of the conductor A. Also, based upon the monitoring operation by the potential meter 4B and the conductor dimension monitor 5C, that is, through the variable control of the feeding, rolling and sending-out speeds of the conductor A by the speed controllers 4C and 6C, the feeding speed of the conductor A upon manufacturing the insulated electric wire D can be uniformly controlled.

Therefore, the enamel wire uniformly covered with the insulating coat B on the conductor A can be obtained, and simultaneously, the improvement in a quality of the insulated electric wire and the stability in the manufacturing thereof can be obtained.

According to the present invention, the feed capstan 3 and the feed dancer roll 4 correspond to the conductor feed means, the conductor rolling unit 5 to the conductor rolling means, the conductor wire drawing unit 7 to the conductor wire drawing means, the conductor annealing unit 9 to the conductor annealing means, the coat baking unit 10 to the coat baking means, and the electric wire winding unit 12 to the electric wire winding means. The present invention is not limited to the preferred embodiment having the above-mentioned parts, but it may be applied to various embodiments having other parts.

For example, the means for monitoring the feeding speed of the conductor is not limited to the potential meter 4B detecting the variation of the position of the rolls 4A and 4A, but it may include other feeding speed monitoring means.

The means for monitoring the dimension of the conductor is not limited to the conductor dimension monitor 5C, for example like a laser measurer optically detecting the dimension of the conductor A rolled by the rolling rolls 5A and 5A, but it may include other dimension monitoring means like a camera measurer.

The means for variably controlling the distance between the rolling rolls 5A and 5A is not limited to the distance adjuster 5B, but it may include other distance adjusting means.

The means for monitoring the sending-out speed of the conductor is not limited to the potential meter 6B detecting the variation of the position of the rolls 6A and 6A, but it may include other sending-out speed monitoring means.

The feeding speed controller 4C includes feeding speed controlling means such as, for example, a personal computer, a CPU, a ROM, and a RAM.

The rolling speed controller 6C includes rolling speed controlling means such as, for example, a personal computer, a CPU, a ROM, and a RAM.

The conductor A is not limited to the above-mentioned circular cross-sectional shape, but it has egg-like, square, and oval cross-sectional shapes when it is cut off on the vertical plane in an axial direction thereof. Also, the material of the conductor may be formed of a conductive metal like aluminum, silver, copper and so on. Generally, copper is widely used as the material of the conductor, and in this case, low oxygen copper or oxygen-free copper, instead of pure copper, may be appropriately used.

Figure 6:
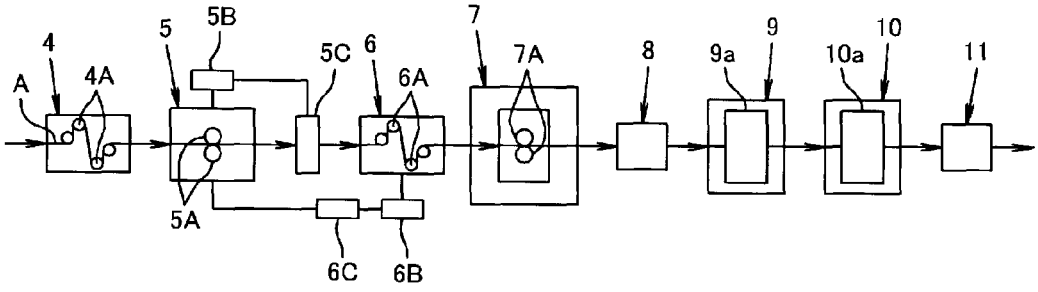
FIG. 6 is a flow chart showing a method of manufacturing an insulated electric wire according to another embodiment of the present invention wherein the conductor is rolled by means of the conductor rolling unit and the conductor wire drawing unit.

Also, as shown in FIG. 6, the conductor A rolled by the rolling rolls 5A and 5A of the conductor rolling unit 5 is rolled only by the rolling rolls 7A and 7A, without any wire-drawing through the die 7B of the conductor wire drawing unit 7, and in this case, the equivalent operation and effect to the above-mentioned embodiment of the present invention can be obtained.

Besides, FIG. 6 shows a method of manufacturing an insulated electric wire according to another embodiment of the present invention wherein the conductor A is rolled by the rolling rolls 5A and 5A of the conductor rolling unit 5 and the rolling rolls 7A and 7A of the conductor wire drawing unit 7.

Figure 7:
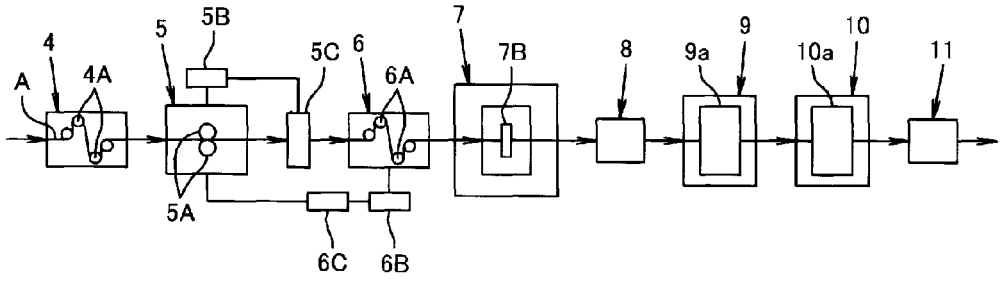
FIG. 7 is a flow chart showing a method of manufacturing an insulated electric wire according to still another embodiment of the present invention wherein the conductor is rolled, without having any rolling process through the conductor wire drawing unit.

As shown in FIG. 7, the conductor A rolled by the rolling rolls 5A and 5A of the conductor rolling unit 5 is wire-drawn only through the die 7B of the conductor wire drawing unit 7, without any rolling by the rolling rolls 7A and 7A, and in this case, the equivalent operation and effect to the above-mentioned embodiment of the present invention can be obtained.

Besides, FIG. 7 shows a method of manufacturing an insulated electric wire according to still another embodiment of the present invention wherein the conductor A rolled by the rolling rolls 5A and 5A of the conductor rolling unit 5 is wire-drawn by the die 7B of the conductor wire drawing unit 7.

Figure 8:
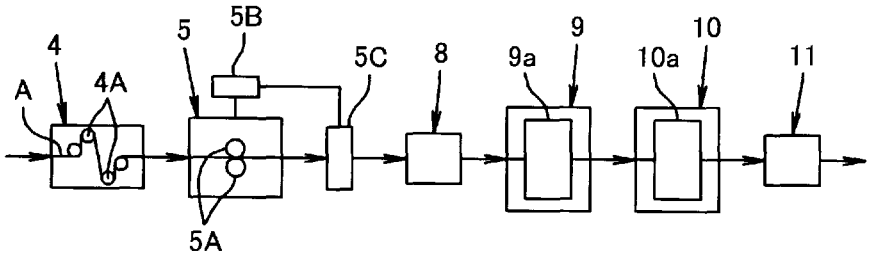
FIG. 8 is a flow chart showing a method of manufacturing an insulated electric wire according to yet another embodiment of the present invention wherein the conductor is rolled, without having any wire-drawing process through the conductor wire drawing unit.

As shown in FIG. 8, if the conductor A is rolled to the predetermined thickness and width through the rolling rolls 5A and 5A of the conductor rolling unit 5, there is no need to wire-draw the conductor A through the rolling rolls 7A and 7A and the die 7B of the conductor wire drawing unit 7, which makes the manufacturing process and the entire configuration substantially simplified and also makes the manufacturing time shortened.

Besides, FIG. 8 shows a method of manufacturing an insulated electric wire according to yet another embodiment of the present invention wherein the conductor A rolled by the rolling rolls 5A and 5A of the conductor rolling unit 5 is fed from the conductor rolling unit 5 to the coat baking unit 10.

As mentioned above, the present invention has various embodiments.

The invention claimed is:

1. A method of manufacturing an insulated electric wire comprising:

supplying a conductor to a conductor rolling process in a conductor feeding process;

rolling the conductor in the conductor rolling process in a predetermined shape;

rolling the conductor in a conductor wire drawing process with a pair of first rolling rolls rotating freely without a drive mechanism and passing the conductor through a die to wire-draw the conductor;

annealing the conductor wire-drawn in the conductor wire drawing process with a conductor annealing unit and supplying the conductor to a coat baking process:

forming an insulating coat on the conductor in the conductor baking process at a constant feeding speed to obtain the insulated electric wire; and winding an electric wire in an electric wire winding process covered with the insulating coat in the coat baking process with an electric wire winding unit, wherein, in the conductor rolling process, a pair of second rolling rolls is rotated with the drive mechanism to roll the conductor in the predetermined shape, and a distance between the second rolling rolls is variably controlled according to a change in a width of the conductor after rolling and according to the constant feeding speed of the conductor in the conductor baking process, in the conductor rolling process, said second rolling rolls are rotated with the drive mechanism at a rotating speed variably controlled according to an elongation of the conductor in a longitudinal direction thereof after rolling and according to the constant feeding speed of the conductor in the conductor baking process, and an entire process from the conductor feeding process to the electric wire winding process is conducted in a tandem arrangement.

2. The method of manufacturing an insulated electric wire according to claim 1, said conductor is supplied to the pair of second rolling rolls at a speed variably controlled so that a variation in tension of the conductor is suppressed.

3. An apparatus for manufacturing an insulated electric wire, comprising:

a conductor feeding unit for supplying the conductor to a conductor rolling unit;

the conductor rolling unit for rolling a conductor in a predetermined shape;

a conductor wire drawing unit for rolling the conductor with a pair of first rolling rolls rotating freely without a drive mechanism and passing the conductor through a die to wire-draw the conductor in the predetermined shape;

a conductor annealing unit for annealing the conductor wire-drawn with the conductor wire drawing unit and supplying the conductor to the coat baking unit;

a coat baking unit for forming an insulating coat on the conductor at a constant feeding seed; and an electric wire winding unit for winding an electric wire covered with the insulating coat with the coat baking unit, wherein said conductor rolling unit includes a pair of second rolling rolls rotated with the drive mechanism to roll the conductor in the predetermined shape, the pair of second rolling rolls having a distance therebetween variably controlled according to a change in a width of the conductor after rolling and according to the constant feeding speed of the conductor, said second rolling rolls are rotated with the drive mechanism at a rotating speed variably controlled according to an elongation of the conductor after rolling and according to the constant feeding speed of the conductor, and an entire series from the conductor feeding unit to the electric wire winding unit is arranged in a tandem arrangement.

4. The apparatus for manufacturing an insulated electric wire according to claim 3, wherein said conductor is supplied at a speed variably controlled according to a comparison result between the rotating speed of the second rolling rolls and the constant feeding speed of the conductor supplied to the second rolling rolls.

5. The method of manufacturing an insulated electric wire according to claim 1, wherein, in the conductor rolling process, said conductor passes through the second rolling rolls after passing through a first dancer roll.

6. The method of manufacturing an insulated electric wire according to claim 1, wherein, in the conductor rolling process, said conductor passes through the second rolling rolls before passing through a second dancer roll.

7. The method of manufacturing an insulated electric wire according to claim 1, wherein, in the conductor rolling process, said second rolling rolls have the distance therebetween variably controlled according to the change in the width of the conductor monitored by a conductor dimension monitor.

8. The apparatus for manufacturing an insulated electric wire according to claim 3, wherein said conductor rolling unit further includes a first dancer roll and a second dancer roll so that the second rolling rolls are situated between the first dancer roll and the second dancer roll.

9. The apparatus for manufacturing an insulated electric wire according to claim 3, wherein said conductor rolling unit further includes a conductor dimension monitor for monitoring a dimension of the conductor.

* * * * *